US009790072B2

(12) United States Patent
Clusserath et al.

(10) Patent No.: US 9,790,072 B2
(45) Date of Patent: Oct. 17, 2017

(54) FILLER ELEMENT AND FILLING SYSTEM

(71) Applicant: KHS GmbH, Dortmund (DE)

(72) Inventors: Ludwig Clusserath, Bad Kreuznach (DE); Dieter-Rudolf Krulitsch, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 148 days.

(21) Appl. No.: 14/363,021

(22) PCT Filed: Nov. 23, 2012

(86) PCT No.: PCT/EP2012/004867

§ 371 (c)(1),
(2) Date: Jun. 5, 2014

(87) PCT Pub. No.: WO2013/083239

PCT Pub. Date: Jun. 13, 2013

(65) Prior Publication Data

US 2014/0360624 A1 Dec. 11, 2014

(30) Foreign Application Priority Data

Dec. 6, 2011 (DE) ..... 10 2011 120 164

(51) Int. Cl.
*B65B 1/30* (2006.01)
*B67C 3/00* (2006.01)
*B67C 3/26* (2006.01)

(52) U.S. Cl.
CPC ..... *B67C 3/001* (2013.01); *B67C 3/262* (2013.01); *B67C 3/2637* (2013.01); *B67C 2003/2685* (2013.01)

(58) Field of Classification Search
CPC ..... B67C 3/001; B67C 3/2637; B67C 3/262; B65B 3/04; B65B 3/10; B65B 3/26
(Continued)

(56) References Cited

U.S. PATENT DOCUMENTS 4,653,551 A * 3/1987 Sindermann ..... B67C 3/2614 141/302
4,749,010 A * 6/1988 Petell ..... B67C 3/2608 141/115

(Continued)

FOREIGN PATENT DOCUMENTS

DE 4338669 5/1995
DE 19631079 2/1998

(Continued)

OTHER PUBLICATIONS

Axial Definition of Axial by Merriam-Webster.*

*Primary Examiner* — Paul R Durand
*Assistant Examiner* — Randall Gruby
(74) *Attorney, Agent, or Firm* — Occhiuti & Rohlicek LLP

(57) ABSTRACT

A filler element for filling containers with liquid includes a housing, a housing opening area, a protective space, a channel formed therein, a liquid valve in the channel, a dispensing opening downstream from the valve, and a fill-level-determining element comprising first and second ends. The fill-level-determining element is routed through the housing and extends by the first end into the dispensing opening during filling and is routed out of the housing by the second end at a housing opening area in a sealed manner with a protective space directly adjacent to it. The protective space holds a length of the fill-level-determining element that corresponds to an axial adjustment lift. The protective space opens by an axial opening lift of the fill-level-determining element that differs from its axial adjustment lift. The protective space opens by the axial opening lift of the fill-level-determining element into a space formed in the housing.

9 Claims, 4 Drawing Sheets

(58) Field of Classification Search
USPC ..... 141/4, 5, 63, 89, 91, 92, 144–146, 153
See application file for complete search history.

(56) References Cited

U.S. PATENT DOCUMENTS 5,150,743 A * 9/1992 Walusiak ..... B67C 3/28 141/144
5,320,144 A * 6/1994 Ahlers ..... B67C 7/0073 141/1
5,377,726 A * 1/1995 Clusserath ..... B67C 3/286 141/261
5,402,833 A * 4/1995 Clusserath ..... B67C 3/12 141/293
5,445,494 A * 8/1995 Hanson ..... F04D 1/06 415/107
5,501,253 A * 3/1996 Weiss ..... B67C 3/2614 141/198
5,558,135 A * 9/1996 Kronseder ..... B67C 3/10 141/39
5,727,606 A * 3/1998 Weiss ..... B67C 3/2631 141/198
6,155,314 A * 12/2000 Ding ..... B67C 3/2617 141/192
6,220,310 B1 * 4/2001 Emmer ..... B67C 3/10 141/11
6,817,386 B2 * 11/2004 Tsukano ..... B67C 3/281 141/146
7,571,749 B2 * 8/2009 Stocchi ..... B67C 3/004 141/105
8,434,530 B2 * 5/2013 Conforti ..... B67C 3/10 141/105
9,205,937 B2 * 12/2015 Krulitsch ..... B67C 3/26
9,242,848 B2 * 1/2016 Murray ..... B67D 7/42
2001/0045242 A1 * 11/2001 Clusserath ..... B67C 3/286 141/144
2002/0179177 A1 * 12/2002 Tsukano ..... B67C 3/10 141/57
2005/0150571 A1 * 7/2005 Schmoll ..... B67C 3/06 141/144
2005/0178466 A1 * 8/2005 Tanikaw ..... B67C 3/2614 141/57
2005/0241726 A1 * 11/2005 Clusserath ..... B67C 3/04 141/144
2005/0257499 A1 * 11/2005 Krulitsch ..... B67C 3/2614 53/281
2006/0137762 A1 * 6/2006 Ruble ..... B65B 39/004 141/144
2007/0006939 A1 * 1/2007 Clusserath ..... B67C 3/2628 141/40
2010/0108180 A1 * 5/2010 Clusserath ..... B67C 3/004 141/1
2011/0290374 A1 * 12/2011 Clusserath ..... B67C 3/06 141/67
2011/0303322 A1 * 12/2011 Clusserath ..... B67C 3/286 141/8
2013/0061980 A1 * 3/2013 Clusserath ..... B67C 3/2622 141/7
2013/0112311 A1 * 5/2013 Krulitsch ..... B67C 3/26 141/1
2014/0366982 A1 * 12/2014 Clusserath ..... B67C 3/26 141/104
2015/0013833 A1 * 1/2015 Clusserath ..... B67C 3/06 141/5
2015/0231812 A1 * 8/2015 Klatt ..... B29C 49/12 264/532
2016/0009533 A1 * 1/2016 Clusserath ..... B67C 3/002 141/91

FOREIGN PATENT DOCUMENTS

DE 102009009339 8/2010
EP 0337913 10/1989

* cited by examiner

10681

FILLER ELEMENT AND FILLING SYSTEM

RELATED APPLICATIONS

This application is the national stage entry, under 35 USC 371, of PCT application PCT/EP2012/004867, filed on Nov. 23, 2012, which claims the benefit of the Dec. 6, 2011 priority date of DE 10 2011 120 164.9, the contents of which are herein incorporated by reference.

FIELD OF INVENTION

The invention is directed to container processing, and in particular, to filling containers with liquid.

BACKGROUND

Various kinds of filler elements for filling containers, including bottles, with liquid contents, for example drinks, are known. It is also known to provide, on a filler element, an element that determines the fill level of the contents in the filled container. This element, which is hereinafter called the "fill level-determining element", can be in the form of a rod-shaped probe with at least one electric probe contact, or in the form of a gas-return pipe. It is also known to set the fill level reached in a particular container at the end of the filling process by axial adjustment of the fill level-determining element during filling with a first end extending into the container. The fill level-determining element is furthermore routed through the filler-element housing of the filler element and projects out of the filler-element housing by a length lying at a distance from the first end on a housing opening area.

To prevent the penetration of dirt and/or microorganisms into the process side of the filler element by means of the housing opening area, i.e. into areas of the filler element transporting the contents and/or process gas and/or vacuum, in particular when adjusting the fill level-determining element, it is known to provide a protective space in the filler element immediately after the opening area.

During the filling operation, this protective space is exposed, for example, to the pressure of an inert gas, separated from areas transporting process gas and/or contents by at least one seal and made such that it can accommodate, at least in the filling mode of the filler element, a length of the fill level-determining element on the housing side adjacent to the housing opening area, the length corresponding to the adjustment range of this element.

A disadvantage in this known filler element is that this protective space is formed by the internal space of a pipe that projects out of the filler-element housing above the dispensing opening, and that, on the lower end of this pipe enclosing the fill level-determining element, the sealing element separating the protective space from the process side is provided in the form of a solid ring seal. In the filling mode, the fill level-determining element is routed through the ring seal while the protective space is sealed. In a cleaning and/or sterilization mode, the fill level-determining element is moved back by its first end so far into the filling element housing that the protective space on the ring seal is open. Considerable disadvantages arise from this because the annular space enclosing the fill level-determining element is used as the protective space and is therefore not available as the gas space or gas channel for the medium to pass through, i.e. additional fluid paths may have to be provided in the filler element. Additionally, the ring seal separating the protective space from the process side is exposed to the risk of damage, for example the risk of damage from glass splinters from burst containers or bottles. In addition, during a CIP cleaning and/or sterilization in which the protective space and the fill level-determining element are likewise cleaned and/or sterilized, it is not possible to also concurrently clean and/or to sterilize a part of the fill level-determining element extending into the protective space during the filling operation because this will be outside the filler element at the time of the cleaning and/or sterilization.

SUMMARY

It is the task of the invention to disclose a filler element that avoids the aforesaid disadvantages and, with high operating reliability, in particular also allows an optimal cleaning and/or disinfection and/or sterilization of the fill level-determining element.

In one aspect, the invention features a filler element for filling containers with liquid contents. The filler element comprising a housing, a housing opening area, a protective space, a liquid channel, a liquid valve in the liquid channel, a dispensing opening, and a fill-level-determining element comprising a first end and a second end. The dispensing opening is downstream from the liquid valve in a direction of flow of the liquid contents. The liquid contents pass through the dispensing opening into the container when the liquid valve is open. The fill-level-determining element, which determines a fill level of the liquid contents in the container, is routed through the filler-element housing and extends by the first end into the dispensing opening during filling of the container and is routed out of the housing by the second end, which is at a distance from the first end, at the housing opening area in a sealed manner with a protective space directly adjacent to the housing opening area. The protective space is sized and configured to hold a length of the fill-level-determining element that corresponds to an axial adjustment lift. The protective space is opened by an axial opening lift of the fill-level-determining element. The axial opening lift of the fill-level-determining element is different from the axial adjustment lift of the fill-level-determining element. The protective space opens by the axial opening lift of the fill-level-determining element into a space formed in the filler-element housing.

In some embodiments, the fill-level-determining element comprises one of a gas-return pipe and a rod-shaped probe with at least one probe contact at the first end.

Other embodiments further include a gas pipe enclosing the fill-level-determining element but spaced from the fill-level-determining element. The gas pipe projects out of the filler-element housing and forms a gas channel that encloses the fill-level-determining element. The gas channel opens into the space formed in the filler-element housing. The protective space is provided in the filler-element housing offset relative to the gas pipe and the gas channel to the second end of the fill-level-determining element.

In another embodiment, the fill-level-determining element can be moved in an opening lift to open the protective space, the opening lift being greater than the maximum adjustment lift.

In yet another embodiment, the fill-level-determining element can be moved to open the protective space in a direction of an underside of the filler element having the dispensing opening.

Some embodiments include a sealing element, a housing recess, and a circular cylindrical section of the housing recess. The protective space is formed by the circular cylindrical section. The sealing element is provided on the fill-level-determining element, and separates the protective space from a process side of the filler element, portions of the filler element that transport process gas, portions of the filler element that transport contents, or portions of the filler element that support a vacuum. The sealing element can be moved by the fill-level-determining elements in a piston-like manner in the section of the housing recess.

Yet other embodiments have a further section adjacent to the section that forms the protective space. The further section is in a direction of the opening lift and forms or is connected to the space formed in the filler-element housing.

In some embodiments, the protective space defines a flow path in the filler-element housing. The flow path enables the protective space to be exposed to a pressurized inert gas during filling. When the protective space is open, the flow path enables either supply or removal of a treatment medium for treatment of the fill-level-determining element and either or both the protective space and the housing recess that forms the protective space. The treatment medium is either a cleaning medium or sterilization medium. Treatment includes cleaning and sterilizing.

Another embodiment includes a rotary filling machine comprising a transport element. The filling element, and identical filling elements, are disposed on the transport element of the rotary filling machine.

Further developments, benefits and application possibilities of the invention arise also from the following description of examples of embodiments and from the figures. In this regard, all characteristics described and/or illustrated individually or in any combination are categorically the subject of the invention, regardless of their inclusion in the claims or reference to them. The content of the claims is also an integral part of the description.

As used herein, "containers" include cans, bottles, tubes, pouches, in each case made of metal, glass and/or plastic, as well as other packaging means that are suitable for filling with liquid or viscous products.

As used herein, "cleaning" refers to cleaning and/or sterilizing and/or disinfecting. "Cleaning medium" thus refers to a medium that carries out any combination of cleaning, sterilizing, and disinfecting.

As used herein, "contaminants" refers to dirt, microorganisms, and any impurities.

As used herein, "below" means closer to the underside of the filler element and "above" means further from the underside of the filling element.

As used herein, the expressions "substantially" and "approximately" mean deviations from exact values in each case by +/−10%, and preferably by +/−5% and/or deviations in the form of changes not significant for functioning.

BRIEF DESCRIPTION OF THE DRAWINGS

These and other features and advantages of the invention will be apparent from the accompanying detailed description and the accompanying figures in which.

DETAILED DESCRIPTION

Figure 1:
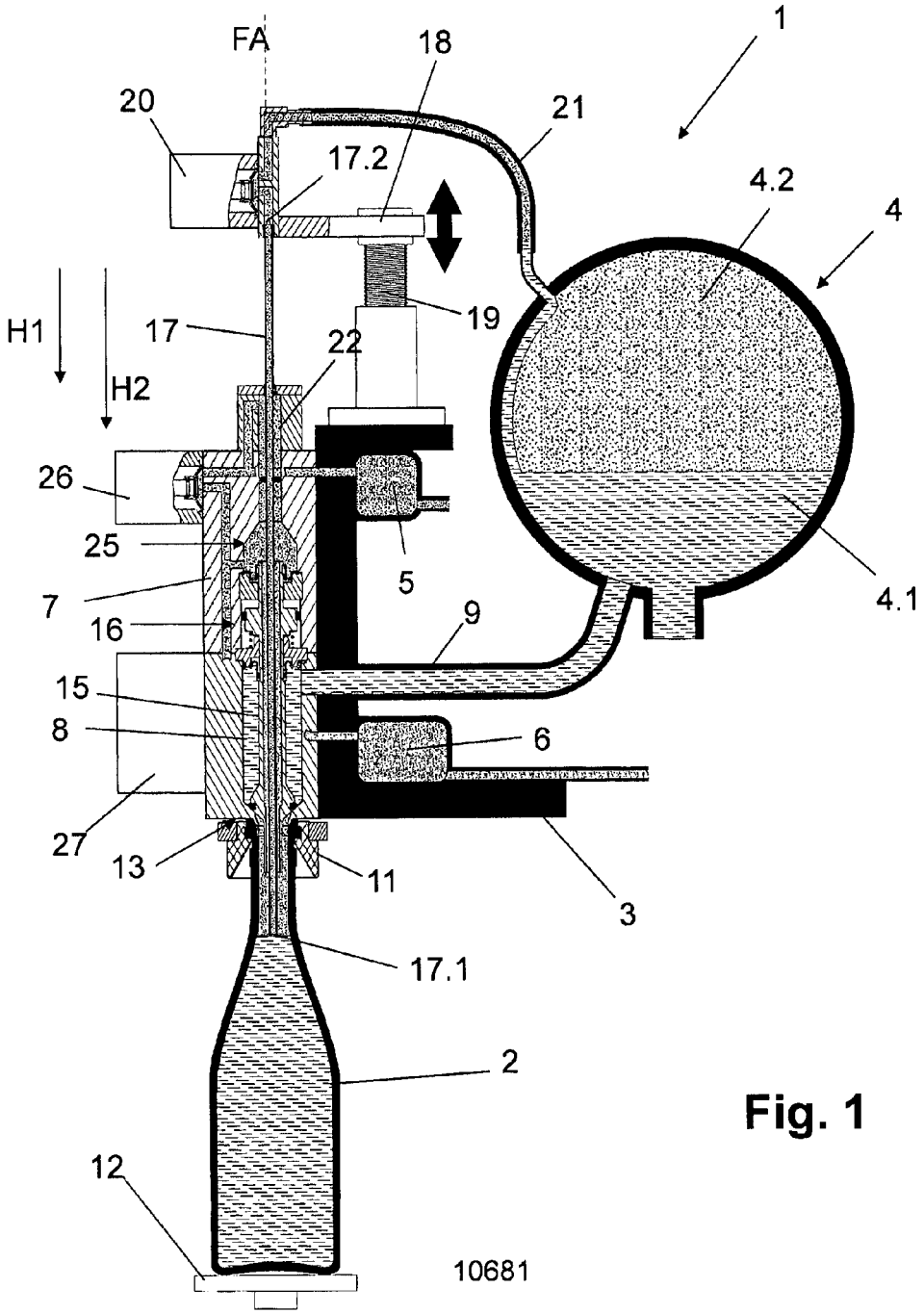
FIG. 1 shows a filler element being used for filling a bottle.
Figure 2:
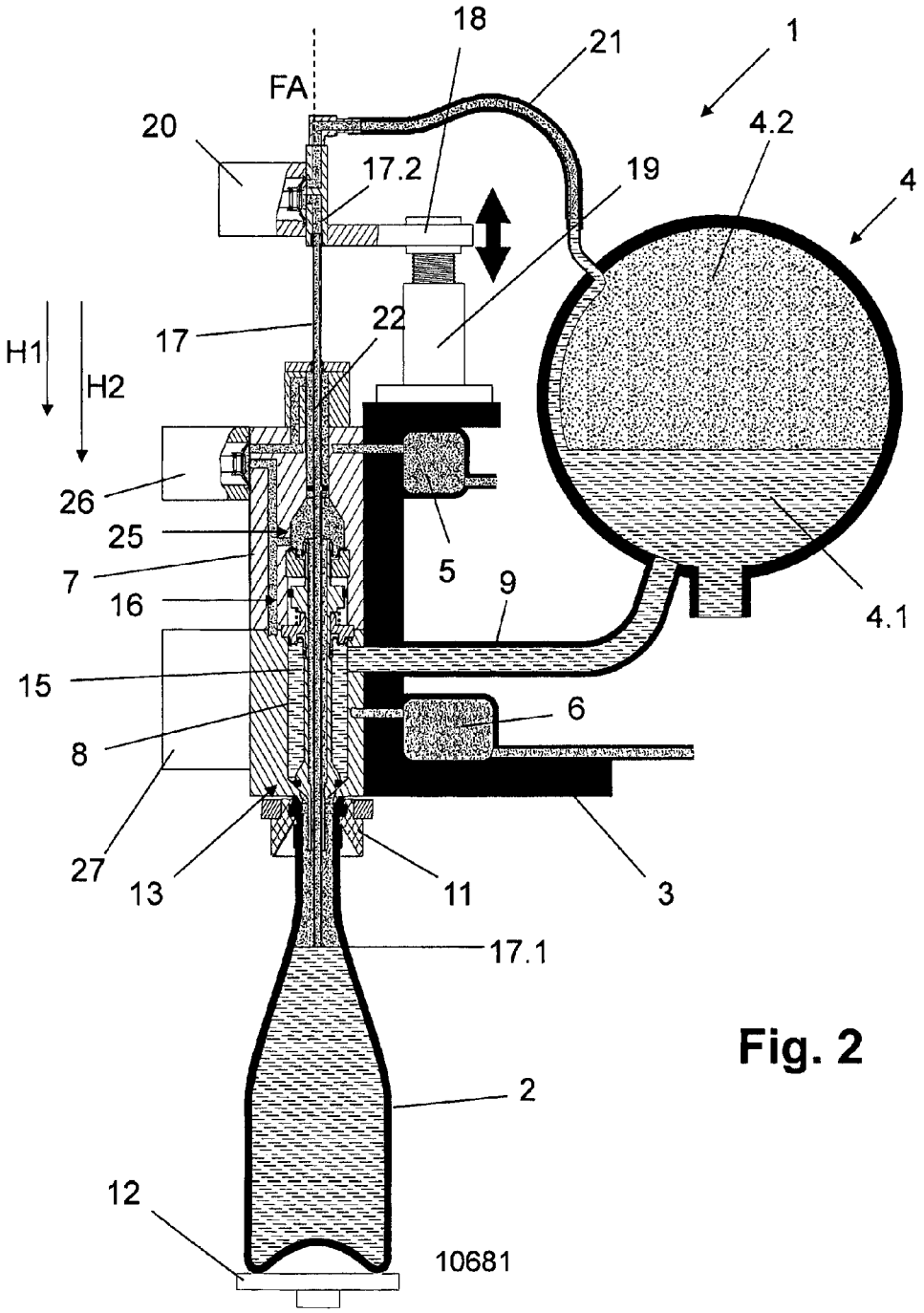
FIG. 2 shows the filler element of FIG. 1 being used to fill a bottle to a different fill level.
Figure 3:
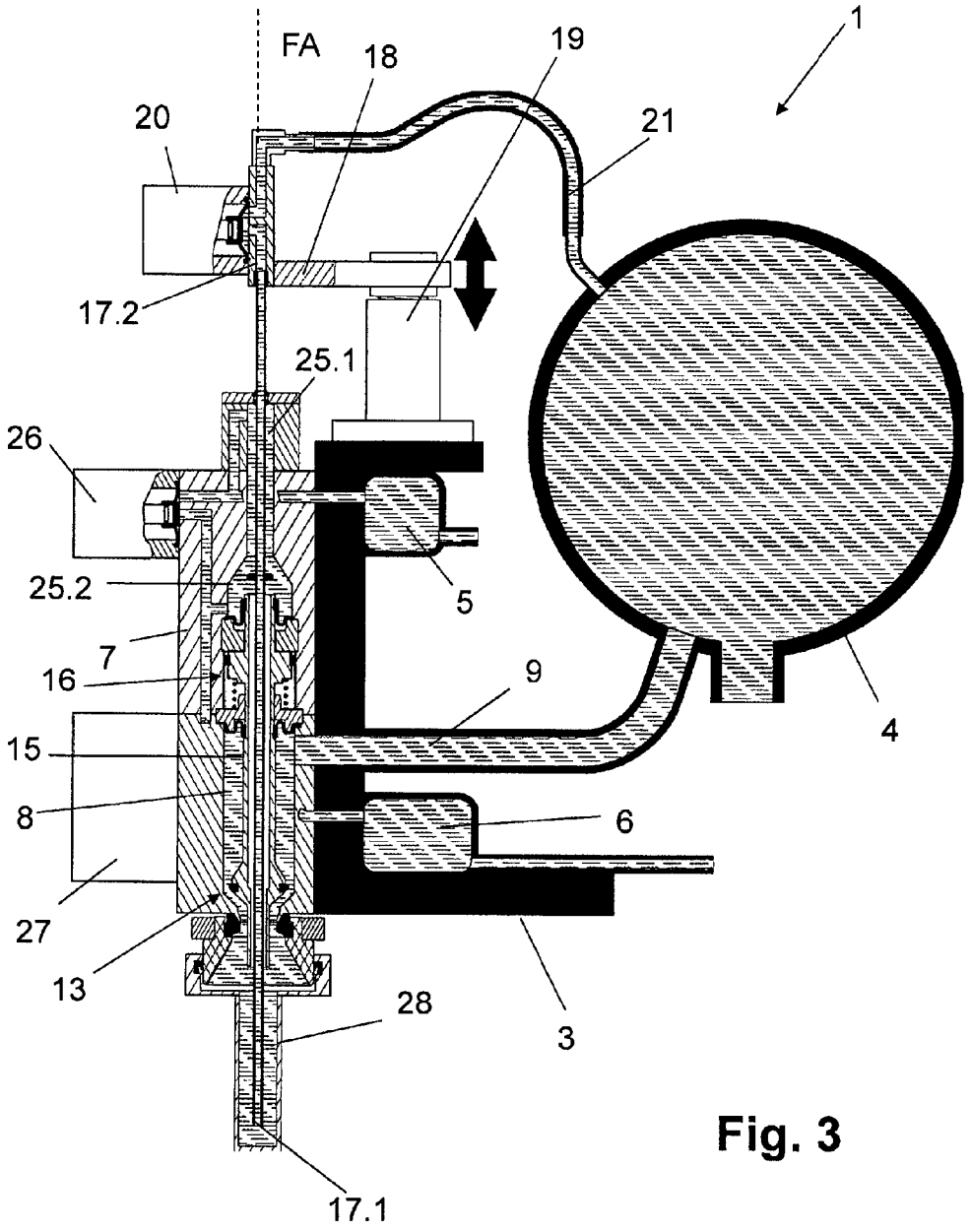
FIG. 3 shows the filler element of FIG. 1 being cleaned.

FIGS. 1-3 show different modes of operation for a filler element 1 that carries out fill-level-controlled filling of containers, such as bottles 2, with liquid contents. FIGS. 1 and 2 show the filler element 1 operating in its filling mode. FIG. 3 shows it operating in its CIP cleaning mode. The filler element 1 is just one of a plurality of identical filler elements on the circumference of a rotor 3 that can be driven to rotate around a vertical machine axis. The rotor 3 is part of a filling system or a filling machine. An annular vat 4 on the rotor 3 supplies liquid content to all of the filler elements 1. In addition, the filling machine includes first and second annular channels 5, 6 that connect to all of the filler elements 1. These annular channels 5, 6 provide gas transport towards or away from the filler elements 1 as described below in detail.

During the filling operation, liquid content partially fills the annular vat 4. The liquid content forms a lower liquid space 4.1 and, above it, a gas space 4.2 within the annular vat 4. An inert gas fills the gas space 4.2. A suitable inert gas is $CO_2$ gas. In the case of a pressure-filling of the bottles 2, the inert gas is pressurized to a filling pressure.

The first and second annular channels 5, 6 can have different functions depending on the filling method. In the case of pressure filling, the first annular channel 5 transports pressurized inert gas to be used for rinsing and/or pretensioning a bottle 2 sealed against the filler element 1. The second annular channel 6 can function as a pressure-release channel.

The filler element 1 comprises a filler-element housing 7 that forms a liquid channel 8. A product pipe 9 connects an upper area of the liquid channel 8 to the liquid space 4.1 of the annular vat 4.

On the underside of housing 7, the liquid channel 8 forms an annular dispensing opening 10. During filling, a bottle plate, or container carrier 12 assigned to the filler element 1 raises the bottle so that it can be sealed against the filling element 1. A centering cone 11 having a seal in the area of the dispensing opening 10 ensures that the bottle's mouth lies sealed against the filling element 1. Liquid content then flows into the bottle through this annular dispensing opening 10.

Figure 4:
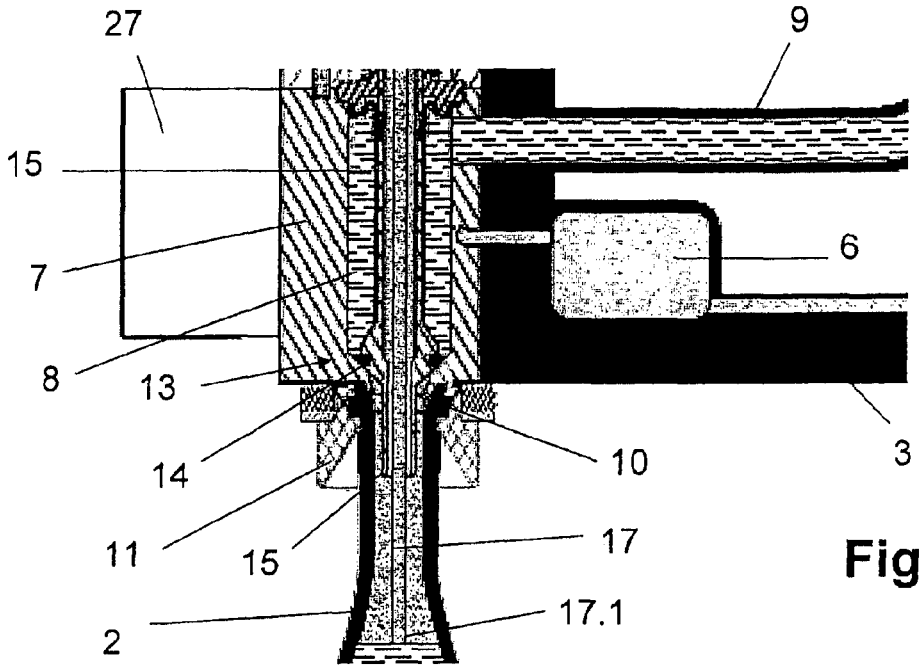
FIG. 4 is a close-up of the filler element of FIG. 1 where the bottle meets the filler element.

Referring to FIG. 4, a gas pipe 15 coaxial with a filler-element axis FA acts as a valve plunger that protrudes through the dispensing opening 10 and into the bottle 2 during filling thereof. The gas pipe 15 also forms a valve body 14 of a liquid valve 13 that lies in the liquid channel 8 upstream of the dispensing opening 11. The valve body 14 interacts with a valve surface in the liquid channel 8. At the end of the filling process, shown in FIGS. 1 and 2, the liquid valve 13 is in its closed state.

An inner space of a housing 7 houses a pneumatic actuator 16 that acts on the gas pipe 15. This pneumatic actuator 16 opens and closes the liquid valve 13. The inner space is separate from the liquid channel 8 and sealed from the liquid channel 8.

The gas pipe 15 surrounds a gas-return pipe 17 that is coaxial with the filler-element axis FA, thus defining an annular channel therebetween. The gas-return pipe 17 has an open top end 17.2, an open bottom end 17.1, and a wall that extends between them. This wall is spaced apart from the gas pipe 15 that surrounds it.

During the filling operation, the bottom end 17.1 of the gas-return pipe 17 projects into a head space of a bottle 2. This enables the gas-return pipe 17 to function as a fill-level-determining element.

The gas-return pipe 17 projects through the top of the filler-element housing 7 so that its top end couples 17.2 to a support arm 18. A first control-valve 20 on the support arm 18 connects the top end 17.2 of the gas-return pipe 17 to the gas space 4.2 of the annular vat 4 via a flexible pipe 21.

An adjustment device 19 axially moves the gas-return pipe 17 downward from an upper starting position by either an axial adjustment lift H1 or an enlarged opening lift H2. The axial adjustment lift H1 sets different fill levels during the filling mode of the filler element 1. The enlarged opening lift H2 moves the gas-return pipe 17 into a cleaning position.

In the process of axially adjusting the gas-return pipe 17 to set the bottles' fill level, there is a risk that contaminants will penetrate into critical areas or into the process side of the filler element 1. To suppress this risk, the gas-return pipe 17 is routed through a lock space, or protective space 22 formed in the housing 7. The protective space 22 in the illustrated embodiment is shaped like a circular cylinder that is concentric to the filler-element axis FA. The axial extent of this protective space 22 along the filler-element axis FA is at least equal to the maximum extent of the axial adjustment lift H1. During filling, the first annular channel 5 provides pressurized inert gas to fill the protective space 22.

Figure 5:
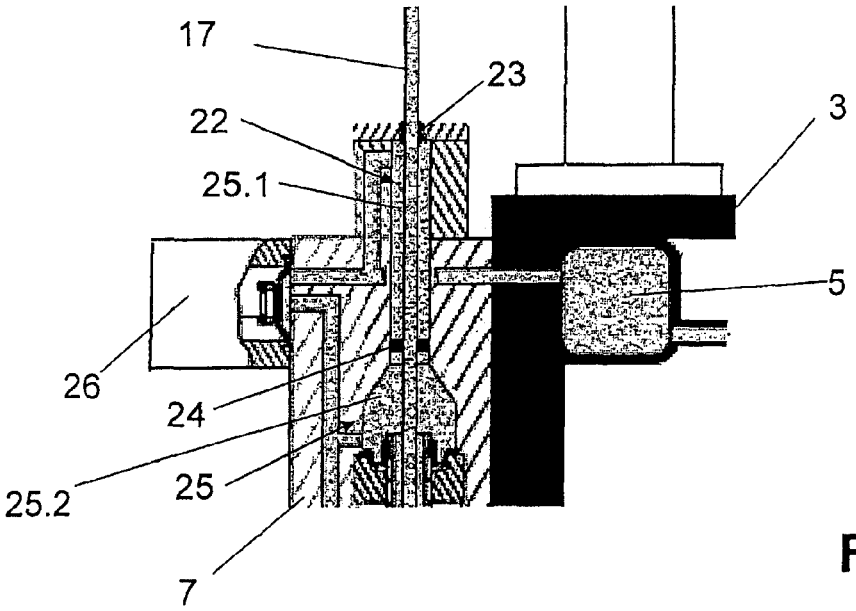
FIG. 5 is a close-up of the filler element of FIG. 1 at the end furthest from the bottle.

Referring to FIG. 5, on its way through the top side of the housing 7, the gas-return pipe 17 passes through a first seal 23. A second seal 24 surrounds the gas-return pipe 17 below the first seal 23. The second seal 24 moves with the gas-return pipe 17 in a piston-like manner as it seals a gap between the gas-return pipe 17 and a circular cylindrical inner surface of the protective space 22. As such, the second seal 24 closes the protective space 22 on a lower side thereof during the normal filling operation or with the filler element 1 in the filling mode.

A housing recess 25 forms the protective space 22. The housing recess includes a first recess-section 25.1 and a second recess-section 25.2 that is adjacent to and below the first recess-section 25.1. At the second recess-section 25.2, the housing recess 25 is wider than it is at the first recess-section 25.1.

The second recess-section 25.2 forms a gas space into which the upper open end of the gas pipe 15 or the annular gas channel formed between the inner surface of the gas pipe 15 and the outer surface of the gas-return pipe 17 opens.

The first recess-section 25.1 and the protective space 22 have an axial length that is larger than the extent to which the gas-return pipe 17 moves between the maximum fill-level setting, shown in FIG. 1 and the minimum fill-level setting shown in FIG. 2.

Second and third control-valves 26, 27 control flow of controlled gas paths within the housing 7. During filling, these controlled paths permit pressurized inert gas from the first annular channel 5 to fill the protective space 22. The second control-valve 26 connects the first annular channel 5 to the second recess-section 25.2. The third control-valve 27 connects the second recess-section 25.2 to the second annular channel 6.

With the filler element 1 or with the filling system formed by these filler elements, various filling methods are possible. These include normal pressure filling and Trinox filling.

In normal pressure-filling filling, the first step is to execute an axial adjustment lift H1 to axially adjust the gas-return pipe 17. This sets the fill level for all the filler elements 1.

The next step is to seal a bottle 2 against the filler element 1 and to pre-tension it with inert gas. With the bottle 2 having been suitably pre-tensioned, the liquid valve 13 and the first control-valve 20 open. As it flows into the bottle 2, the incoming liquid forces inert gas out of the bottle 2, up through the gas-return pipe 17, through the open first control-valve 20, through the flexible pipe 21, and finally, into the gas space of the annular vat 4.

Eventually, the fill-level becomes high enough to immerse the lower open end 17.1 of the gas-return pipe 17 in liquid. Even with the liquid valve 13 still open, this stops the inflow of the contents into the bottle 2 once a state of equilibrium has been reached between the level of the contents in the annular vat 4 and the contents column that forms in the gas-return pipe 17. The level of the gas return-pipe's lower end 17.1 thus determines the fill level of the contents in the bottle 2.

Finally, the liquid valve 13 and the first control-valve 20 both close, the bottle's head-space is depressurized, and the filled bottle 2 is lowered from the filler element 1.

It is also possible for the filler element 1 to execute a Trinox filling method. As was the case with the normal filling method, the position of the gas-return pipe's lower end 17.1 determines the fill level.

In Trinox filling, the first step is to execute an axial adjustment lift H1 to axially adjust the gas-return pipe 17. This sets the fill level for all the filler elements 1.

The Trinox method includes intentionally over-filling a pre-tensioned bottle 2 so that its fill-level is temporarily above the desired fill level. This occurs with the liquid valve 13 open, the first control-valve 20 closed, and the second control-valve 26 open. In this state, incoming liquid forces inert gas out of the bottle 2 through the gas channel formed between the gas pipe 15 and the gas-return pipe 17. The inert gas passes into the second recess-section 25.2 and then into the first annular channel 5 through the opened second control-valve 26.

The next step is to close the liquid valve 13 and open the first control-valve 20. The head-space of the bottle 2 continues to be exposed to pressure through the still-open second control-valve 26. This returns contents from the overfilled bottle 2 to the annular vat 4 via the gas-return pipe 17, the open first control-valve 20, and the flexible pipe 21. This continues until the lower end 17.1 of the gas-return pipe 17 is above the fill-level in the bottle 2.

After closing the first control-valve 20 and after depressurizing the head-space of the filled bottle 2, for example through the open third control-valve 27, the filled bottle 2 is removed from the filler element.

Occasionally, it is useful to carry out a CIP procedure to clean the housing recess 25, and in particular, the first recess-section 25.1, the protective space 22 that it forms, and that portion of the gas-return pipe that is held within the filler element 1 during the filling operation. The CIP procedure typically begins by arranging a rinsing cap 28 on each filler element 1 of the filling machine. Next, the gas-return pipe 17 moves axially downward from its upper lift position by an amount equal to the enlarged opening lift 12. This moves the second seal 24 into the second recess-section 25.2 and exposes the protective space 22 to the second recess-section 25.2. The liquid valve 13 then opens, as well as the annular dispensing opening 10 enclosing the gas pipe 15, the lower open end of the gas pipe 15, and the lower open end 17.1 of the gas-return pipe 17.

The housing recess 25, the gas pipe 15, and the rinsing cap 28 together define a long continuous space through which cleaning medium flows during the CIP procedure. This space is long enough to enclose the entire gas-return pipe 17, including the length by which the gas-return pipe 17 extends through the filler-element housing 7 during the filling operation and the extent to which it projects past the underside of this housing. During CIP cleaning and/or sterilization, this space holds the gas-return pipe 17. This exposes all parts of the gas-return pipe to cleaning fluid and guarantees optimal cleaning and/or disinfection of its critical areas.

Other advantages and particularities of the filler element 1 are that the protective space 22 for the adjustment of the gas-return pipe 17 is arranged above the annular gap formed between the gas pipe 15 and the gas-return pipe 17 and that this annular gap can be used as a gas path or gas channel for routing the process gas during the normal filling operation. Another advantage is the placement of the second seal 24, which, during the filling operation, separates the protective space 22 from the process side, i.e. from the gas space formed by the second recess-section 25.2. The filler element 1 houses the second seal 24 in its interior of the filler element 1, thereby shielding it from damaged by, for example, shards from burst bottles 2.

The invention has been described above using an example of an embodiment. It is clear that numerous modifications and variations are possible without thereby departing from the inventive idea underlying the invention.

As but one example, in the embodiments described thus far, the gas-return pipe 17 is used as a fill-level-determining element. However, some embodiments replace the gas-return pipe 17 with a rod-shaped probe having an electric probe-contact.

Having described the invention, and a preferred embodiment thereof, what we claim as new and secured by Letters Patent is:

1. An apparatus comprising a filler element for filling containers with liquid contents, said filler element comprising a housing, a housing opening area, a protective space, a liquid channel, a liquid valve, a dispensing opening, and a fill-level-determining element comprising a first end and a second end, wherein said first end is at a distance from said second end, wherein said liquid channel is formed in said filler element housing, wherein said liquid contents flow through said liquid channel, wherein said liquid valve is in said liquid channel, wherein said dispensing opening is downstream from said liquid valve in a direction of flow of said liquid contents, wherein said liquid contents pass through said dispensing opening into said container when said liquid valve is open, wherein said fill-level-determining element determines a fill level of said liquid contents in said container, wherein said fill-level-determining element is routed through said filler element housing, wherein said fill-level-determining element extends by said first end into said dispensing opening during filling of said container, wherein said fill-level-determining element is routed out of said housing by said second end at said housing opening area in a sealed manner with said protective space directly adjacent to said housing opening area, wherein said protective space is sized and configured to hold a length of said fill-level-determining element, wherein said length corresponds to an extent to which an adjustment device, by causing an axial adjustment lift, moves said fill-level determining element between a maximum fill-level setting and a minimum fill-level setting, wherein said protective space is opened by an enlarged opening lift that differs from said axial adjustment lift, and wherein, as a result of having executed said enlarged opening lift, said protective space opens into a space formed in said filler element housing.

2. The apparatus of claim 1, wherein said fill-level-determining element comprises a gas-return pipe.

3. The apparatus of claim 1, further comprising a gas pipe enclosing said fill level-determining element and spaced from said fill-level-determining element, wherein said gas pipe projects out of said filler element housing, wherein said gas pipe forms a gas channel that encloses said fill level-determining element, wherein said gas channel opens into said space formed in said filler element housing, and wherein said protective space is between said filler element housing and said gas pipe.

4. The apparatus of claim 1, wherein said enlarged opening lift moves said fill level-determining element to open said protective space, said enlarged opening lift having an extent that is greater than a maximum extent of said axial adjustment lift.

5. The apparatus of claim 1, wherein said fill level-determining element can be moved to open said protective space in a direction of an underside of said filler element having said dispensing opening.

6. The apparatus of claim 1, further comprising a sealing element, a housing recess, and a circular cylindrical section of said housing recess, wherein said protective space is formed by said circular cylindrical section, wherein said sealing element is provided on said fill-level-determining element, wherein said sealing element separates said protective space from a structure selected from the group consisting of a process side of said filler element, portions of said filler element that transport process gas, portions of said filler element that transport contents, and portions of said filler element that support a vacuum, wherein said sealing element can be moved by said fill level-determining elements in a piston-like manner in said section of said housing recess.

7. The apparatus of claim 1, further comprising a further section adjacent to said section that forms said protective space, said further section being in a direction of said enlarged opening lift and forming or being connected to said space formed in said filler element housing.

8. The apparatus of claim 1, wherein said protective space defines a flow path in said filler element housing, wherein said flow path enables said protective space to be exposed to a pressurized inert gas during filling, wherein, when said protective space is open in a direction of an underside of said filler element having said dispensing opening, said flow path enables at least one of supply and removal of a treatment medium for treatment of said fill-level-determining element and at least one of said protective space and a housing recess that forms said protective space, wherein said treatment medium comprises at least one of cleaning medium and sterilization medium, and wherein treatment comprises one of cleaning and sterilizing.

9. The apparatus of claim 1, further comprising a rotary filling machine comprising a transport element, wherein said filling element, and a plurality of identical filling elements, are disposed on said transport element of said rotary filling machine.

* * * * *